US006949060B2

(12) United States Patent
Lenk

(10) Patent No.: US 6,949,060 B2
(45) Date of Patent: Sep. 27, 2005

(54) DEVICE AND METHOD FOR FOLDING A FLEXIBLE MATERIAL WEB

(75) Inventor: Christian Lenk, Winterthur (CH)

(73) Assignee: KORTEC GmbH Business Technology (DE)

( * ) Notice: Subject to any disclaimer, the term of this patent is extended or adjusted under 35 U.S.C. 154(b) by 0 days.

(21) Appl. No.: 10/479,006

(22) PCT Filed: May 25, 2002

(86) PCT No.: PCT/DE02/01906

§ 371 (c)(1),
(2), (4) Date: Nov. 24, 2003

(87) PCT Pub. No.: WO02/094697

PCT Pub. Date: Nov. 28, 2002

(65) Prior Publication Data

US 2004/0147384 A1 Jul. 29, 2004

(30) Foreign Application Priority Data

May 25, 2001 (DE) ..... 101 25 452

(51) Int. Cl.[7] ..... B31F 1/08
(52) U.S. Cl. ..... 493/424; 493/444; 493/476
(58) Field of Search ..... 493/424, 442, 493/475, 476, 413, 414

(56) References Cited

U.S. PATENT DOCUMENTS

| | | | | |
|---|---|---|---|---|
| 2,821,387 A | | 1/1958 | Faeber | |
| 3,913,904 A | | 10/1975 | Occhetti | |
| 4,074,901 A | * | 2/1978 | Catallo | 493/413 |
| 4,212,422 A | | 7/1980 | Rauchfuss, Jr. et al. | |
| 4,573,670 A | | 3/1986 | Felix | |
| 5,007,623 A | * | 4/1991 | Unkuri et al. | 270/39.05 |
| 5,616,113 A | * | 4/1997 | Van Den Bergh | 493/23 |
| 5,701,717 A | * | 12/1997 | Gutknecht | 53/117 |
| 5,820,539 A | * | 10/1998 | Strahm | 493/412 |
| 6,514,186 B2 | * | 2/2003 | Catallo | 493/414 |

FOREIGN PATENT DOCUMENTS

| | | |
|---|---|---|
| DE | 21 37 706 | 5/1980 |
| DE | 91 16 502.4 | 1/1993 |
| DE | 198 03 837 | 8/1999 |
| FR | 2 739 873 | 4/1997 |

* cited by examiner

*Primary Examiner*—Eugene Kim
(74) *Attorney, Agent, or Firm*—Reed Smith LLP

(57) ABSTRACT

A device and a method are described for folding a flexible material web using at least one pair of counterrotating laying rollers, between which the material web may be fed to a folding location, the laying rollers being part of a laying carriage which is movable over the folding length of the material web with reversible orientation. The object of the present invention is to guide the material web to the folding location with its position and composition largely unimpaired. This object is achieved in that the laying carriage includes at least two transport bands, which rotate around the laying rollers and set them into motion, the material web is transportable at least partially guided between the transport bands, and the speed of the material web has the same absolute value as the speed of the transport bands.

24 Claims, 15 Drawing Sheets

DEVICE AND METHOD FOR FOLDING A FLEXIBLE MATERIAL WEB

CROSS-REFERENCE TO RELATED APPLICATION

This application claims priority of International Application PCT/DE 02/01906, filed May 25, 2002 and German Application No. 101 25 452.0, filed May 25, 2002, the complete disclosures of which are hereby incorporated by reference.

BACKGROUND OF THE INVENTION a) Field of the Invention

The present invention relates to a device for folding a flexible material web having at least one counterrotating pair of laying rollers, between which the material web is feedable to a folding location, the laying rollers being part of a laying carriage which may travel over the folding length of the material web with reversible orientation, the laying wagon including at least two transport bands which rotate around the laying rollers, the material web being transportable at least partially guided between the transport bands, and the speed of the material web having the same absolute value as the speed of the transport bands.

Furthermore, the present invention relates to a method of folding a flexible material web, the material web being fed to at least one folding location via at least one counterrotating pair of laying rollers, the material web being moved together with the laying rollers over their folding length, and an orientation change occurring during the method in accordance with a freely selectable folding length, the material web being transported to the folding position between two transport bands which rotate at least around the laying rollers, and the material web being moved at the same speed as the transport bands.

b) Description of the Related Art

The teaching of the present patent application is based on related art which results from FR 2 739 873. Using the device disclosed therein, first, textile fiber web is compressed between the transport bands into nonwoven having one-dimensional fiber alignment. The transport bands thus not only have a transport function, but also play a role in manufacturing. A receiving band is positioned below the laying rollers, which not only has a transport function, but also has the function of allowing additional orientations of the fibers of the nonwoven coming from the laying rollers. The receiving band is at a constant distance to the exit point of the nonwoven from the laying rollers and moves in the same movement plane at a right angle to the movement direction of the laying carriage, over the width of the nonwoven. In this case, zigzag layers arise at an angle of approximately 45°, which lead to the random fiber position of the nonwoven. Only the folding height changes over the thickness of the material, but not the distance between the receiving band and the laying rollers. This nonwoven having a random fiber position is compacted inline, i.e., in the same production process, to the desired product, specifically to the nonwoven material.

In contrast to this, the present patent application is concerned with the implementation of a stack, starting from a finished product. In other words: in the related art forming the species, a fiber web, a completely uncompacted material coming out of a textile comb, is provided to the transport bands and compaction to the nonwoven then occurs between the transport bands. Using the known device, superposition of nonwoven is generally possible, but the implementation of a stack which is suitable for packaging purposes is not possible. In addition, merely from its manufacturing use aspect, the known device is not suitable for compact folding of a material web.

A folding machine results from DE 91 15 502 U1 which includes a laying slide having laying rollers between which the material web is transported to the folding location. The laying slide may be moved with reversible orientation. The material web is moved together with the laying rollers and/or the slide over a specific folding length which corresponds to the length of a pallet. In the folding machine under discussion, the laying rollers are driven using toothed belts and the material web contacts the rollers and is transported between them. In this case, only one roller is ever driven at a time. In the type of material feed to the folding location under discussion, it is disadvantageous that the speed of the material web and the speed of the one driven roller and the other, non-driven roller may be different and friction is generated in this way. Through these speed differences, mechanical strain, skewing, and electrostatic effects of the material web due to increased friction occur, which may lead to quality losses in the material web and the alignment of the stack, and to wrinkling on the folded stack.

Further relevant related art is formed by DE 198 03 837 A1, which is concerned with the folding and stacking of a flexible web in a zigzag stack. First, a web is typically brought vertically between the rollers. While in contact with the rollers, the particular web section runs in the same rotational direction and rotational speed as the rollers. The step of gripping the web using grippers, which are each positioned on the periphery of a roller, now occurs. The gripping is performed perpendicularly to the movement direction of the web. The rib moves with the web material into the gripper mouth. The gripper mouth closes during the further rotational movement. The rib slides out. Before folding may be performed, the step of letting the material web loose is first to be implemented. The release always occurs at the reversal point of the zigzag layer. The back and forth movement during the folding perpendicular to the movement direction of the arriving web occurs in fractions of seconds. The folding is performed in elevators which are moved downward as the stack grows. Stack changes are performed. The known device may be situated in tandem, so that multiple web widths are operated. The known device is disadvantageous in that the folding length of the web is determined by the dimension of the rollers. The smaller the roller dimensions, the more kinks a web has. Straight kinks may lead to impairment of the fiber properties, as the folded web may still remain for some time in the packed form and, in some circumstances, may be loaded with other web stacks. From a constructive and drive-technology viewpoint, however, the maximization of the roller dimensions is limited. Furthermore, impressions arise on the material due to the gripper mouth mimicry, which may impair the appearance of the material surface. In addition, the gripper mimicry is unsuitable in regard to soft materials, since the yielding nature of the material makes the gripping very difficult or, in the event of a high gripper pressure, strong impressions remain visible in the material. When folding different materials, costly machine adaptation is therefore necessary. Furthermore, relative speed and/or the friction of the web to be folded on the preceding layer occurs during the folding, which may in turn be connected to worsening of the position of the preceding layer, its wrinkling or static charge, or even with quality losses of the materials rubbing against one another.

OBJECT AND SUMMARY OF THE INVENTION

Proceeding from the related art according to FR 2 739 873, the present invention is based on the primary object of specifying a device and a method of the type under discussion, which allows high-quality, compact folding of the material web at high speed into a material web stack.

The preceding object is achieved in accordance with the invention in that a device of the type under discussion is implemented and refined in such a way that the height of the folding position is adjustable and the folding position exerts a pressure on a layer of the material web or on a material web stack formed by multiple folded layers of the material web, the counterpressure able to be implemented via the section of the transport band extending parallel to the folding position and/or to the uppermost folded layer, or the counterpressure able to be implemented via the lower section of the holding-down band extending parallel to the folding position and/or to the uppermost folded layer.

Proceeding from FR 2 739 873, it has been recognized that a device used especially for nonwoven manufacturing may also be applied for the folding of already existing flexible material webs of all types, specifically for films, cellulose products, composite materials, textile webs, or the like. According to the present invention, it was recognized that the known intended purpose of the known device, namely implementing a partial step of the manufacturing of nonwoven, may also be exploited for the implementation of a material web stack in connection with the packaging of the folded material web. Furthermore, it has been recognized that the folding may be performed with especially high quality and at an especially high speed if the height of the folding position is adjustable and the uppermost folded layer of the material web stack is not exposed, but rather is in contact with a band positioned above it—in this case either a section of the transport band or the lower section of a separate holding-down band. In this way, compact folding of even low-weight material webs is possible at high speed. Wind influences and air turbulence play no role, and in addition, light, voluminous material webs may easily be compressed. Through the folding within a contact region, it is ensured that no wrinkling arises, and that the edge formation occurs uniformly. Instead of exclusively assigning the holding-down function to the transport band, a separate holding-down band is claimed alternatively. Separation of the material web transport function and the holding-down function is of practical advantage in regard to the implementation of simpler constructions.

In comparison to DE 91 16 502 U1, the material web reaches the folding location with its position and composition largely unimpaired, since—as known from FR 2 739 873—it is guided between two transport bands which have the same speed as the material web itself. Since there is no difference in speed between the transport bands and the material web, electrostatic effects are largely avoided and the material itself is protected through friction reduction and the position of the material web—if not otherwise desired—is maintained. It is of essential significance that the transport bands roll on the material web—whether guided or already folded—without generating friction. The tensile strain is therefore negligible. In contrast, rollers strain the material web through tensile strain, friction, and slip. The reduction in friction is significant above all in regard to the folding of the material web on the preceding layer. The two laying rollers and/or the laying carriage always roll off on the material web, so that worsening of the position of the preceding layer, wrinkling, static charge, or even quality losses of the material itself may not occur. The use of a laying carriage also causes the speed of the uppermost layer of the folded material web and the speed of the material web reaching the uppermost layer, as well as the speeds of the layers in relation to one another, to have the same absolute value.

In regard to the related art known from DE 198 03 837 A1, it is noted that previous stacks formed from a flexible material web never exceed the dimensions of a Euro palette and, as a consequence, have a high number of kinks which may be connected to worsening of the properties of the material structure in these regions. For example, the moisture absorption behavior or even the elasticity behavior may be impaired. If the folding length is freely selectable, the number of kinks may be reduced enormously. Folding lengths may be implemented which correspond to the width of a truck loading surface, and packing material for small package sizes may be saved at the same time. Formats are made available which meet the transport means, the frequency of transport means loading and unloading processes being reduced.

Because of the movement of the laying carriage, the region of the transport band active in relation to the material web, specifically the material web contact region, must be variable. In this context, reference may also be made to a length change of the transport band, the length of the transport band being maintained de facto, but being changed in regard to the material web contact either by coiling or by region displacement. During the movement of the laying carriage, length regions which are sometimes larger and sometimes smaller, depending on the position of the laying carriage, have contact with the material web and exert the holding-down function. Through the contact of the transport band with the uppermost folded material web, above all for light materials with a weight under 60 g/m$^2$, wind influences, air turbulence, or similar influences may be largely prevented. The contact under discussion also allows the folding of the material web at higher speeds, particularly at speeds over 200 m/minute. More uniform transport of the material web up to the folding location is reached if a transport band is assigned to each laying roller, each having its length changeable and one contacting the uppermost layer of the folded material web almost completely, when the laying roller is in the region of the kink. Otherwise, both transport bands may contact the particular uppermost layer of the folded material web spatially located before and after the laying rollers.

If a separate holding-down band is provided instead of the transport band to exert the holding-down function, it may rotate around separate holding-down rollers of the laying carriage. Two holding-down bands are advantageously on both sides of the laying rollers, which allows nearly continuous holding down of the particular uppermost layer of the folded material web.

In regard to the variability of the transport band, the holding-down band may possibly be provided with a support and tensioning device. In the case of simpler constructions, the support and tensioning device may be implemented as a coiling device.

In order that the functionality of the laying carriage may be produced, a drive motor may be provided. Alternatively, a magnetic drive may also be used.

Depending on the desired speed and desired softness and guiding of the folding, multiple material web feed rollers may be provided, which are assigned to the laying carriage, particularly positioned upstream from it. The arrangement of the material web feed rollers may be tailored to the construction conditions of the location of the device according to the present invention, so that there is a large amount of freedom in regard to the transport band shape. Depending on the desired band shape, the material web may, for example, reach the laying rollers vertically or horizontally.

Alternatively to the embodiment which is significant for practice, having one transport band per laying roller and further material feed rollers, further additional transport bands may also be provided which finally convey the material web to the laying rollers.

For somewhat more complicated constructions having multiple material web supply rollers, at least one position adjustment carriage may be provided which works together with the laying carriage. In a constructive aspect, the position adjustment carriage may include a toothed belt which works together with the support and tensioning device already cited. The more position adjustment carriages there are, the larger the gearings which may be implemented and the more precisely and finely the device operates. The high constructive outlay of multiple position adjustment carriages has significance for very extremely sensitive material webs which are nearly unbonded.

Especially advantageously in regard to the feeding of pallets, cartons, or the like and their removal after folding of the material web, the folding location may be positioned on a supporting surface in the form of a conveyor band. The height adjustability of the conveyor band having the folding location represents an essential point for the present invention. A supporting surface in the form of a platform having a simple scissor lift table would also be conceivable, largely manual charging with the folding location and largely manual removal, possibly using a forklift, being implemented. Through the permanent contact of the folded material web with the section of the transport band, parallel to the upper layer, above it, possibly with the lower section of a separate holding-down band, and the corresponding lift controller of the conveyor band, it is possible above all to fold light, voluminous material compactly through light pressure. In this way, the edges are also implemented uniformly for all layers of the folded material web and the kinks at the reversal points are stressed only slightly, since neither intentional pressing nor strong buckling occurs. In addition, the height adjustability of the conveyor band is also advantageous in regard to the balancing of the growing material web stack. The conveyor band may be a component of an automatic conveyor device, which also includes transport devices on the feed and removal sides, which also may be adjustable in height and transport empty floor plates or cartons on and remove the finished material web stacks. The transport devices may be implemented as closed transport bands or also as three-belt or four-belt conveyors.

The laying carriage may be a component of a laying module which may include components already noted, such as material web feed rollers, position adjustment carriages, and the corresponding drive devices connected with them. The laying module itself may in turn be a component of an overall arrangement, which could also include a material web source, a material web unwinder, a cutting device for lengthwise cutting (pinch or shears cutting) of the material into individual material webs and the material feed mimicry and possibly a conveyor device. It is to be noted in regard to the material web source that it may either be implemented by a store or is represented by a roll from which the material web is unwound directly. In practice, a third variant is frequently used, the material coming directly from a production facility or a lining facility. The conveyor device may provide, in addition to the conveyor band already described, transport bands on the supply and removal sides, which transport empty folding locations, such as floor plates, on and transport the finished material web stack away. These may be implemented via belt conveyors which are partially equipped with accessible cover plates. Furthermore, a controller may be provided which positions the finished material web stacks at a defined distance to one another, particularly on an additional transport roller web, which may also be raised using a lifting device and lifts the material web stacks off of the belt conveyors and transports them to a packaging train.

The overall arrangement includes—as described above—multiple components and/or assemblies which are positioned essentially in a main stand. The main stand may be constructed from massive rectangular tubes and have stand girders which allow expansion and/or extension of the main stand. In this way, an overall arrangement including only one laying module may be expanded and/or retrofitted. For example, retrofitting may be performed with two further laying modules, traversing devices for moving the material web over the width of the laying module, including orientation change, folding locations, and conveyor devices. For overall arrangements having more than three laying modules, one to three further main stands may be used, through which up to 24 folding locations and more may be provided.

The laying module or even—in larger devices—multiple laying modules may be positioned parallel or perpendicular to the running direction of the material web unwinder. The modular concept allows good adaptation to existing conditions and a space-saving positioning ability.

It was noted in regard to the type of transport of the material web that the material web may be transported over the width of the laying roller and a zigzag stack is produced. Alternatively, at least two material webs may be fed simultaneously in parallel to at least one folding location. There are three different variants within these alternatives. Two strips may be guided in parallel to a folding location within one laying carriage and implement a material web stack in parallel folds. In addition, in one laying carriage, two strips may be transported to one folding location, but implement two separate material web stacks. Finally, one material web may be fed to each folding location, using two laying carriages positioned next one another, and each implement one material web stack. Further manifold variants of the material web feeding and the folding are conceivable in regard to the number and the folding pattern. A minimum variant in regard to the number of material webs and folding patterns is given if the width of the material web corresponds to the width of the laying rollers and/or the laying carriage. In this case, there would only be a variation width in regard to the folding length per layer folded.

Since the laying rollers are components of a laying carriage according to the present invention, i.e., are of compact construction in comparison to known pivotable laying arms, their width dimensions may have comparatively high values, up to approximately 4000 mm. Dimensions from approximately 1200 mm–2700 mm have been shown to be advantageous in regard to the folding length of the material web stack, which is freely selectable according to the present invention. A folding length of 2400 mm approximately corresponds to the width of a truck loading surface, so that dimensions which meet the requirements of transport means may be achieved and thus reduction of the frequency of loading and unloading processes may be achieved and therefore wage costs and time consumed may also be reduced. The height dimensions of a material web stack may be approximately 800–1500 mm.

In regard to the drive, the laying carriage and possibly the position adjustment carriage(s) may be driven via toothed belts and may be mounted on friction bearings. Alternatively to this, the drive may occur via a second revolving toothed belt drive or directly via a linear drive. As a further alternative to this, the principal of a magnetic drive, particularly as a long-stator linear drive, would also be conceivable, high speed, very low friction, and no vibration being possible in this case. In this case, the laying carriage and the position adjustment carriage would float without contact on a magnetic field.

The overall arrangement or even one single laying module may expediently be controlled. In regard to the overall arrangement, the controller may be laid out in such a way that all movement sequences are driven via individual high-precision AC servomotors. Special software to be developed for this purpose may include integration of multiple software packages. The software packages may include core software of individual laying modules which is stored in a processor card or a special programmable controller. Furthermore, the software packages may contain a central programmable controller for all peripheral sequences and the integration of the various components and/or assemblies, a communication system, particularly in the form of a bus system, and special visualization software.

According to one embodiment, the transport bands may also exert a further function, namely setting the laying rollers of the laying carriage into motion.

Furthermore, the object above, in accordance with the invention, is achieved in regard to a method of the type under discussion, particularly using the device discussed above, which is executed in that the height of the folding position is adjusted, in such a way that, during folding, the top of the uppermost folded layer of the material web is in contact with the transport bands or a holding-down band and the bottom is in contact with the folding position or the material web stack.

As with the device discussed above, it has also been recognized in regard to the method that the adjustability of the height of the folding position, in connection with the permanent contact of the folding material web with the section of the transport band or the lower section of a separate holding-down band above it, which is parallel to the upper layer, leads to light, voluminous materials in particular able to be folded compactly through slight compression and at high speed. In this way, the edges are also implemented uniformly and the kinks at the reversal points are only slightly loaded for all layers of the folding material web, since neither intentional compression nor strong buckling occurs. In addition, the adjustability and height is also advantageous in regard to the balancing of the growing material web stack. Through the material web contact region of the transport band or the holding-down band to the uppermost layer and the pressure producible through the height adjustment, the material web is prevented from slipping and, in addition, the material web is prevented from being contaminated or subjected to other external influences. This also applies for transport between two transport bands.

Reference is made to the general description of the device according to the present invention and the exemplary embodiments therein in regard to further advantageous embodiments of the method according to the present invention, particularly when features are disclosed therein which are also relevant for the method.

In summary, it is noted that using the device according to the present invention and the method according to the present invention, according to which the material web is guided between the transport bands and no relative speed arises, careful, largely wrinkle-free folding of the material web is made possible. In addition, the folding length of the material web is freely settable and high folding speeds may be implemented with uniform, soft folding via the arrangement of further material web feed rollers before the actual laying rollers. The device according to the present invention may operate as an individual machine, a double machine, or in a modular composite, all laying modules being synchronized using control and regulating units. Using the present invention and its embodiments, qualitative and temporal optimization in relation to the related art is achieved. Through the adjustability in height of the folding position and the pressure against the section of the transport band or lower section of the separate holding-down band parallel to the uppermost layer of the folded material web, a material web stack is obtained at high speed, in which no surface damage occurs on the material web, no wrinkling, and no untidy folding thereof. In addition, the material web stack has kinks which are loaded less. Finally, advantages in regard to the transport and the storage may be achieved if large formats are stacked.

There are now various possibilities of advantageously implementing and refining the teaching of the present invention. In this regard, reference is made to multiple exemplary embodiments and designs of the present invention on the basis of the drawing. In connection with the explanation of the exemplary embodiments of the present invention on the basis of the drawing, generally preferred embodiments and refinements of the teaching are explained.

DESCRIPTION OF THE PREFERRED EMBODIMENTS

Figure 1:
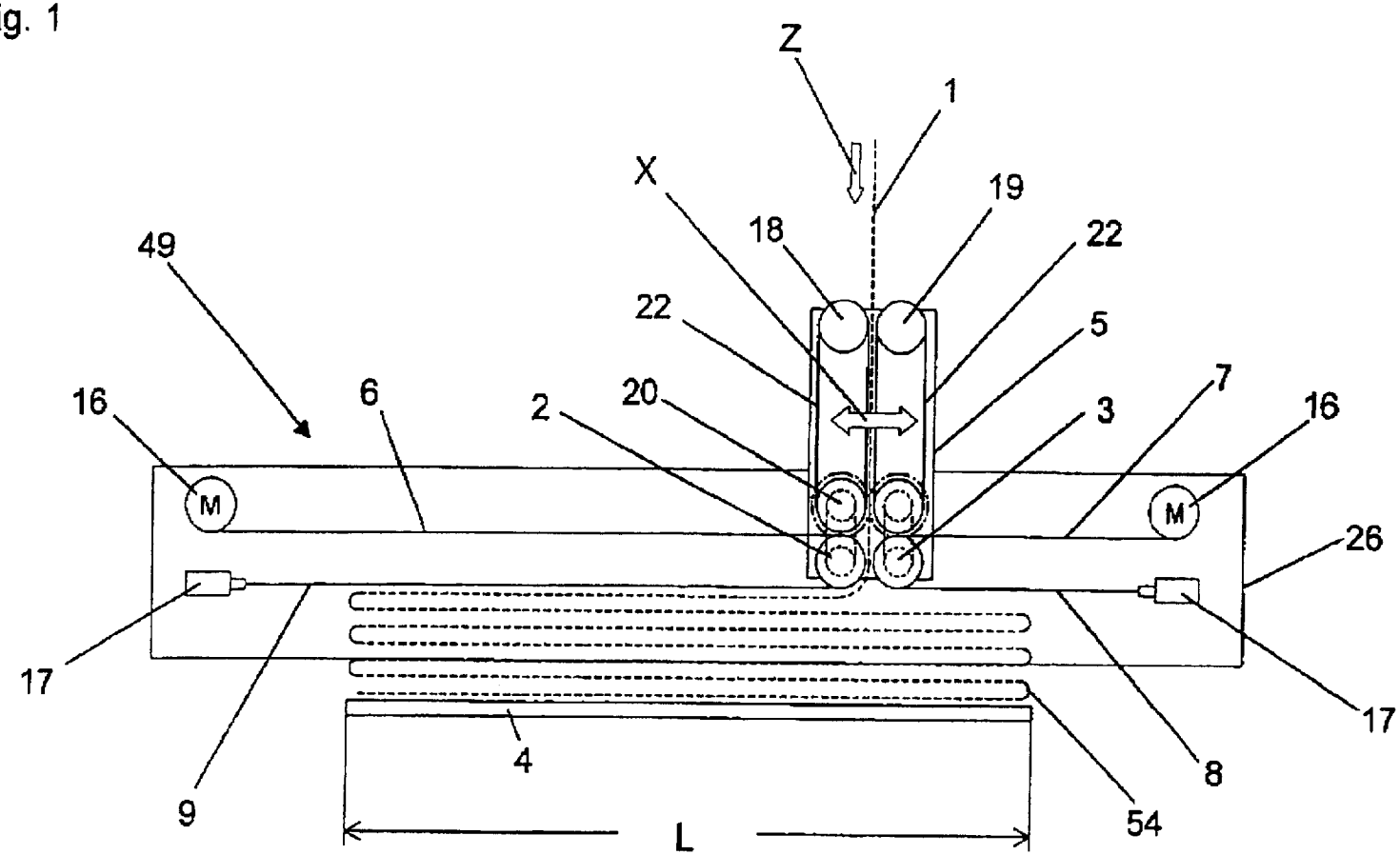
FIG. 1 shows a schematic illustration of a side view of a first exemplary embodiment of the device according to the present invention.

FIGS. 1 through 11 show a device for folding a flexible material web 1 using a counterrotating pair of laying rollers 2, 3, the material web 1 being transported using the laying rollers 2, 3 and fed to at least one folding location 4. According to the present invention, the laying rollers 2, 3 are part of a laying carriage 5, which may be moved over the folding length L of the material web 1 in movement direction X with reversible orientation.

The laying carriage 5 includes two transport bands 6, 7, between which the material of 1 is transported partially guided. The speed of the material web 1 has the same absolute value as the speed of the transport bands 6, 7.

With the exception of the second exemplary embodiment, in all other exemplary embodiments the transport bands 6, 7 of the laying carriage 5 extend at least partially parallel to the folded material web 1. In the sections 8, 9 extending parallel to the folded material web 1, the transport bands 6, 7 exert a holding-down function on the uppermost folded material web 1. The lengthwise dimensions of the active material web contact regions of the sections 8, 9 vary in accordance with the travel position of the laying carriage 5.

Figure 2:
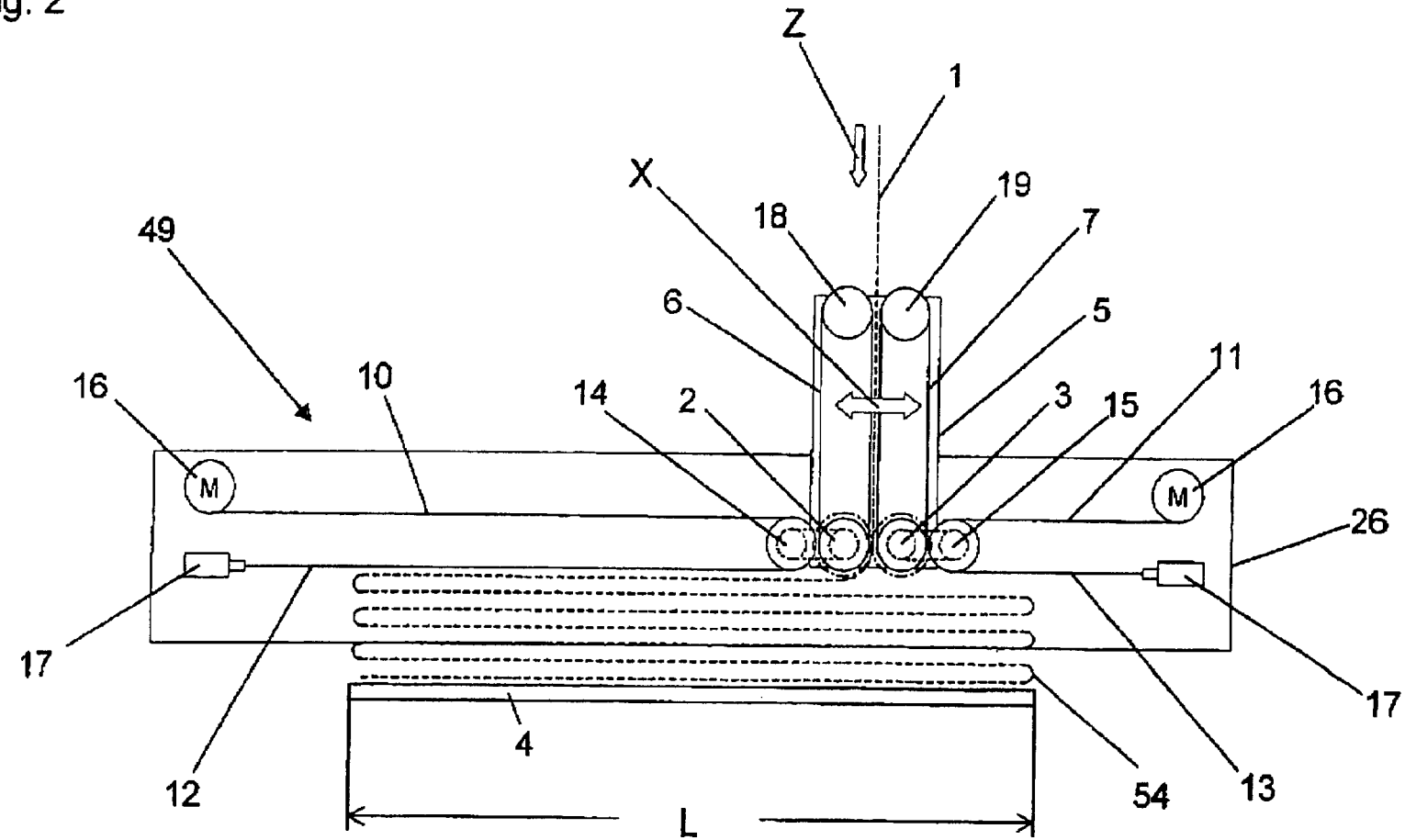
FIG. 2 shows a schematic illustration of a side view of a second exemplary embodiment of the device according to the present invention.

The second exemplary embodiment, which is an alternative to all other exemplary embodiments of the device according to the present invention, is shown in FIG. 2, the laying carriage 5 including two separate holding-down bands 10, 11. The holding-down bands 10, 11 extend parallel to the folding material web 1 and exert a holding-down function on the uppermost folded material web 1 via the particular lower section 12, 13. Furthermore, two separate holding-down rollers 14, 15 are provided, around which the holding-down bands 10, 11 rotate. The lengthwise dimensions of the active material web contact regions of the lower section 12, 13 vary in accordance with the travel position of the laying carriage 5.

For each of the transport bands 6, 7 and holding-down bands 10, 11 shown in FIGS. 1 and 2, a drive motor 16 and a support and tensioning device 17, implemented here as a coiling device in consideration of their varying material web contact regions, are provided. Furthermore, further material web feed rollers 18, 19, 20, 21 are assigned to the laying carriage 5 according to the first exemplary embodiment and further material web supply rollers 18, 19 are assigned according to the second exemplary embodiment, via which the material web 1 is fed to the laying rollers 2, 3 in movement direction Z. In the first exemplary embodiment shown in FIG. 1, two further transport bands 22, 23, which rotate around the material web feed rollers 18 through 21, are also provided in addition to the transport bands 6, 7, whose length may be changed. The exemplary embodiments shown in FIG. 4 et seq. show entire band systems, material feed rollers 31 through 47 being provided, some of which have different functions.

Figure 3:
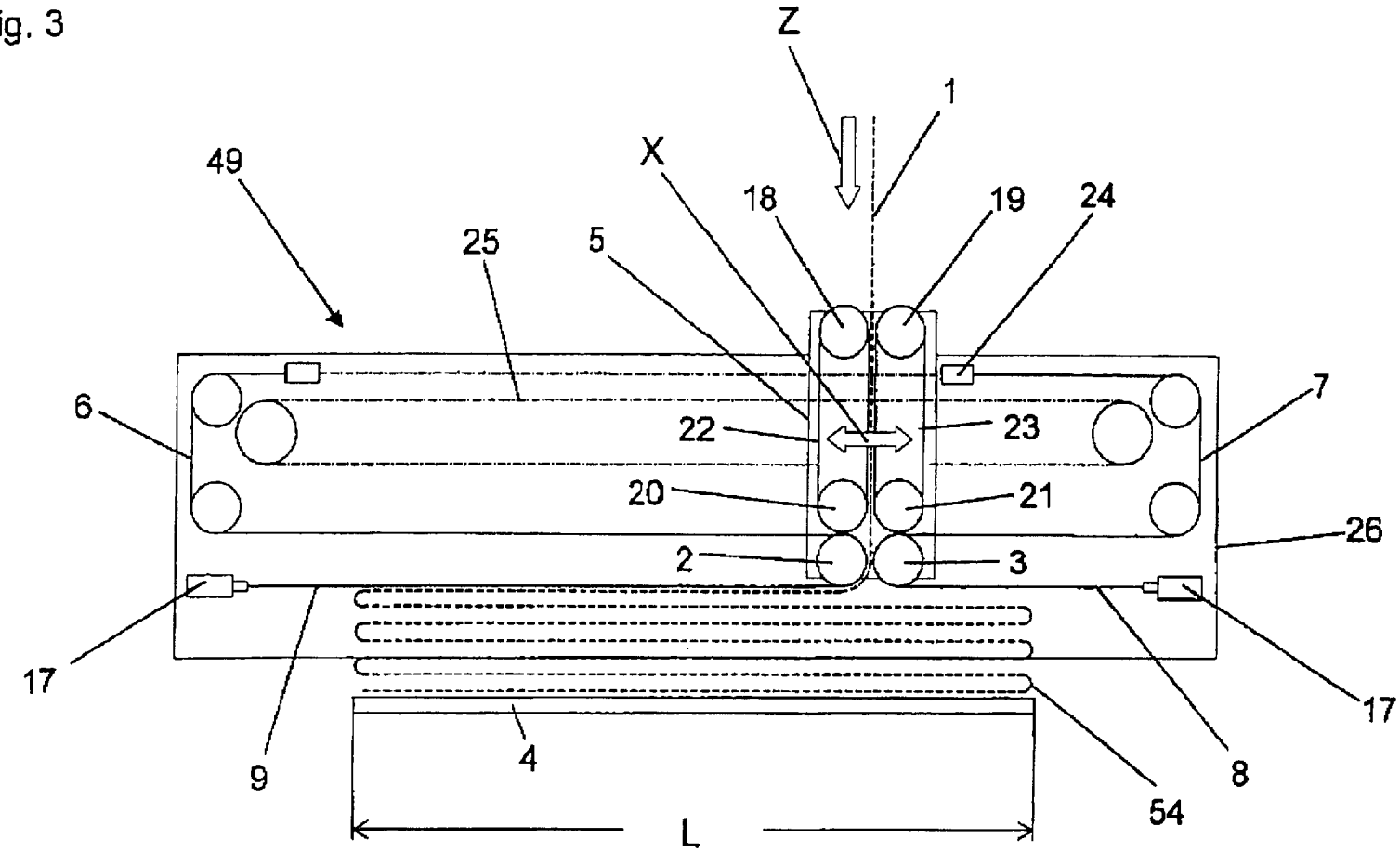
FIG. 3 shows a schematic illustration of a side view of a third exemplary embodiment of the device according to the present invention.
Figure 4:
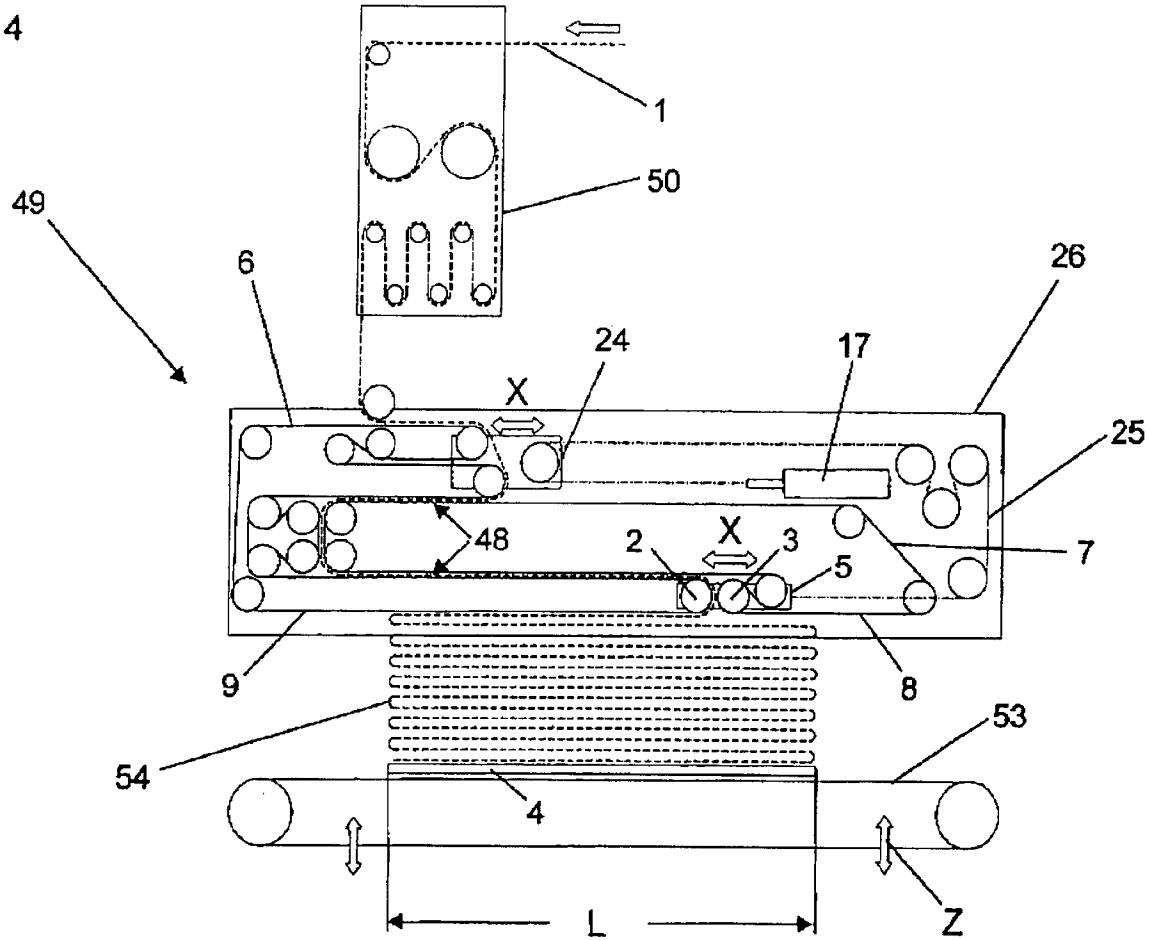
FIG. 4 shows a schematic illustration of a side view of a fourth exemplary embodiment of the device according to the present invention.

The third exemplary embodiment of the device according to the present invention shown in FIG. 3 also has further transport bands 22, 23, each of which rotates around a pair of material web feed rollers 18 and 20 or 19 and 21, respectively. The boxes on the transport bands 6, 7 (not shown in greater detail) stand for mechanical connections to toothed belts 25.

Figure 6:
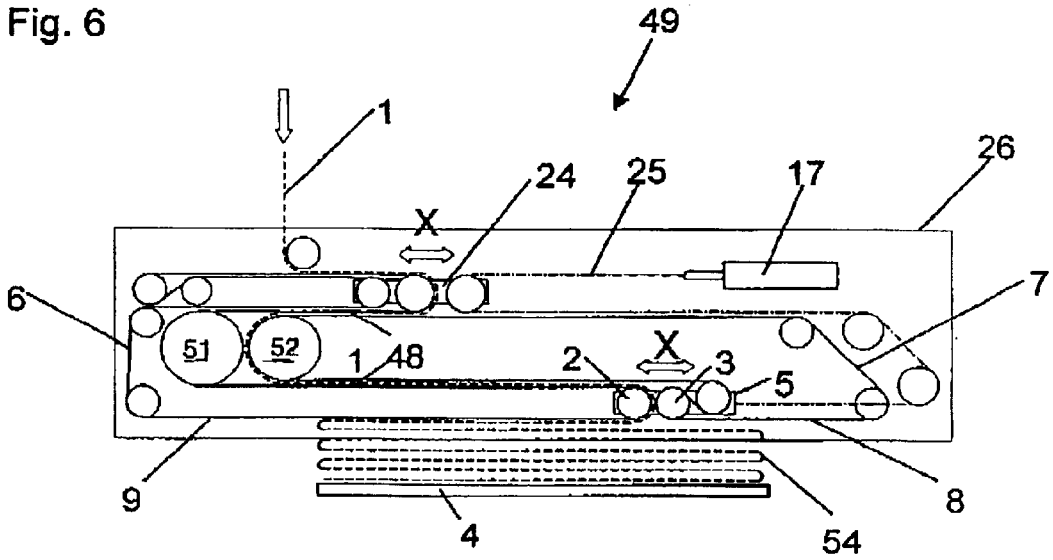
FIG. 6 shows a schematic illustration of the object from FIG. 4 having an altered band system according to a possible variation.
Figure 7:
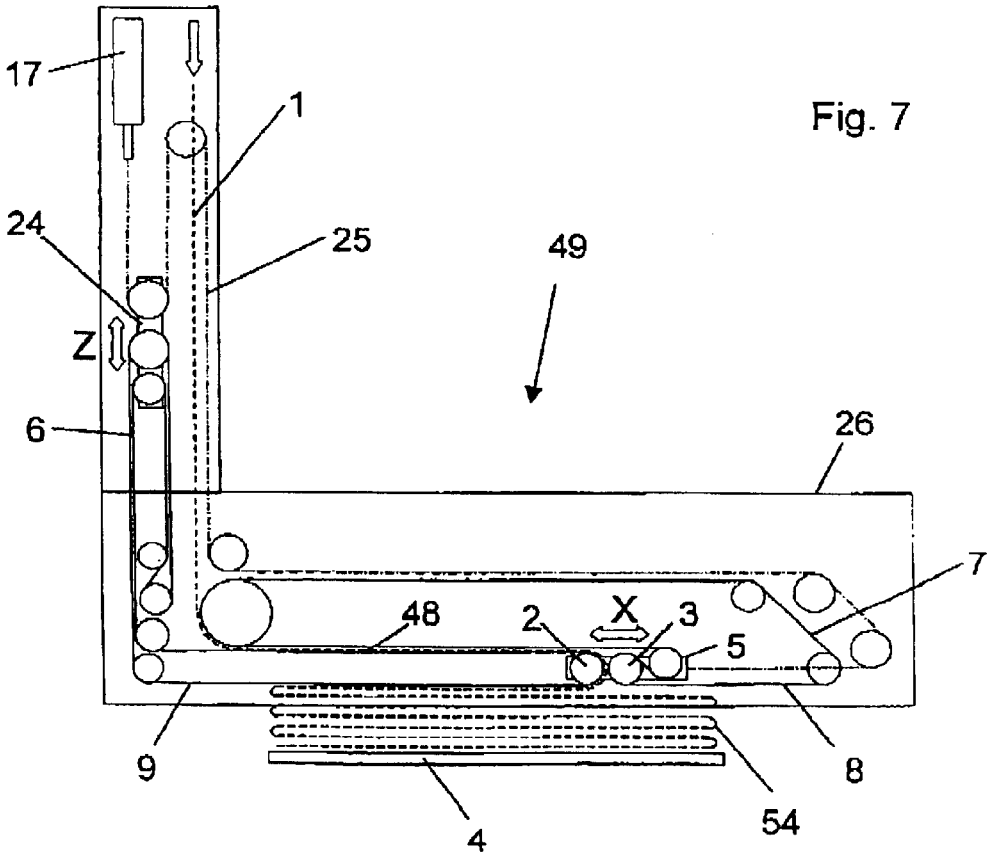
FIG. 7 shows a schematic illustration of the object from FIG. 4 having an altered band system according to a further possible variation.
Figure 8:
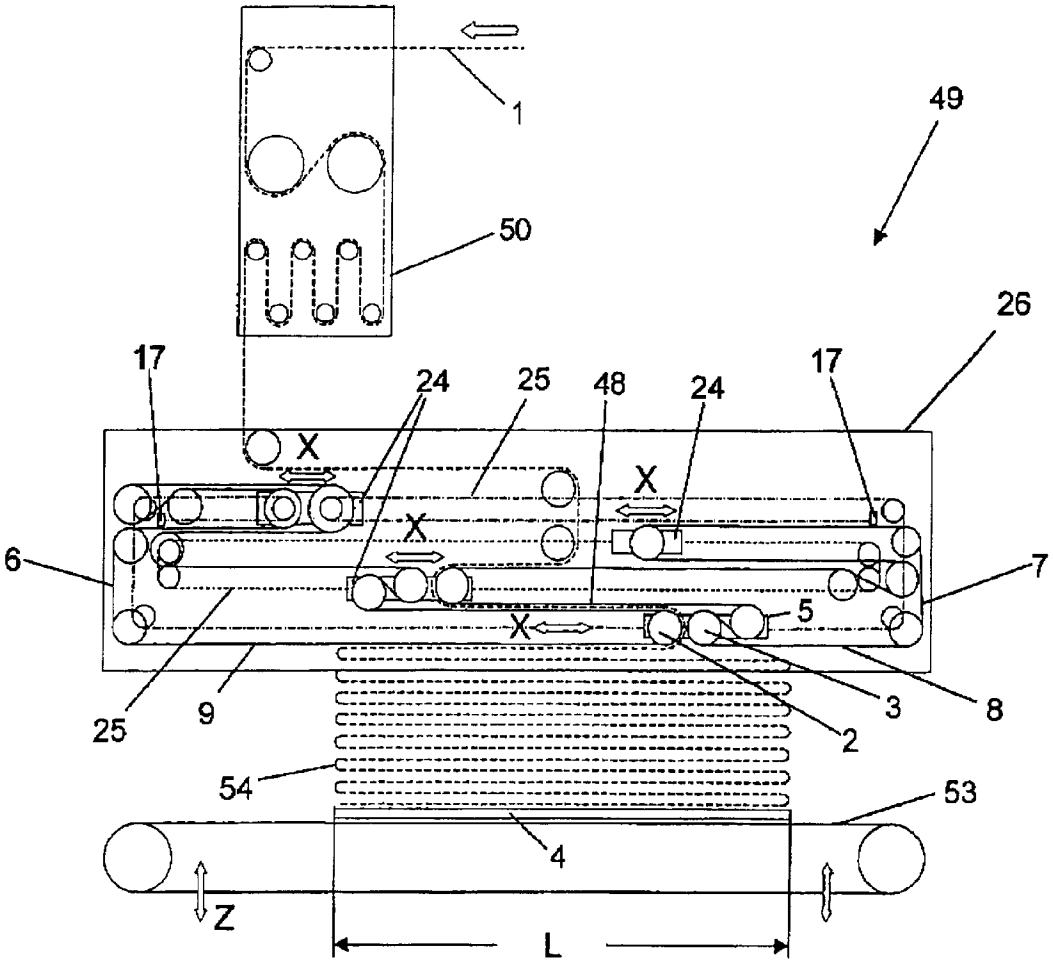
FIG. 8 shows a schematic illustration of a side view of a fifth exemplary embodiment of the device according to the present invention.

The device according to the present invention according to the fourth and fifth exemplary embodiments shown in FIGS. 4 through 12 includes a position adjustment carriage 24, which works together with the laying carriage 5. While only one position adjustment carriage is provided for the fourth exemplary embodiment, the fifth exemplary embodiment shown in FIG. 8 shows three position adjustment carriages 24. The position adjustment carriage 24 includes a finite toothed belt 25 in FIGS. 4 through 12, which is attached to the support and tensioning device 17, provided here as a pneumatic tensioning cylinder.

Figure 5:
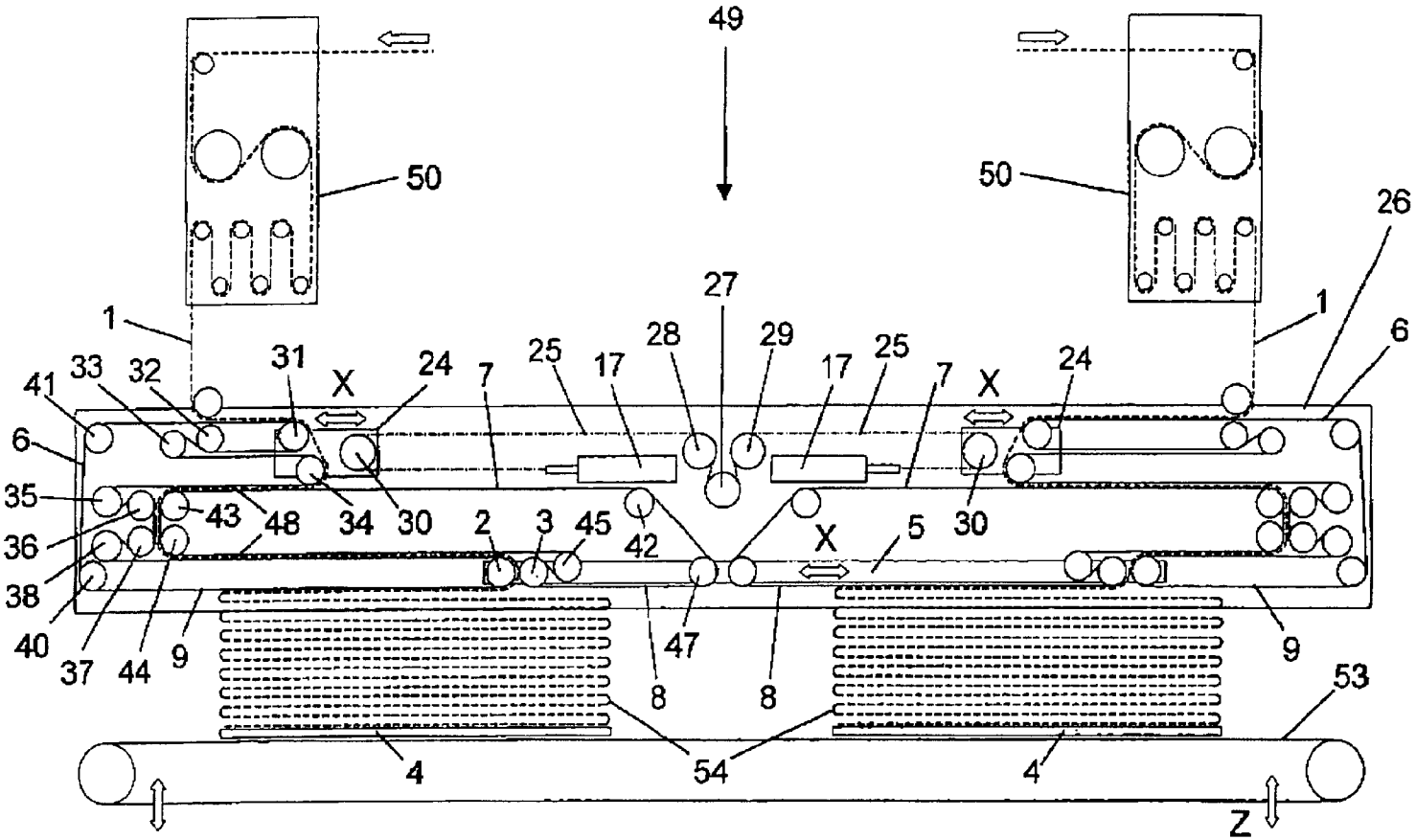
FIG. 5 shows a schematic illustration of the object from FIG. 4 in the form of a double machine having two folding locations.

An alteration of the fourth exemplary embodiment is shown in FIG. 5, the device according to the present invention being a component of a double machine having two folding locations 4. Two laying carriages 5 having the associated band system are installed in mirror image in the stand 26 of the device. The transport bands 6, 7 are connected via the position adjustment carriages 24 to the toothed belts 25, whose ends are attached to the support and tensioning device 17 to tension the transport bands 6, 7. The toothed belts 25 run over toothed belt pulleys, which are identified in greater detail exclusively in FIG. 5 using 27, 28, 29. The toothed belt pulley 25 is driven and gears down the two position adjustment carriages 24 in the preset ratio, 1:2 in this case, via deflection rollers 30. The laying carriages 5, connected via the transport bands 6, 7, are also translationally driven via the toothed belt pulley 27.

In regard to the fourth and fifth exemplary embodiments, the transport of the material web 1 occurs partially between the two transport bands 6, 7, particularly in a region which runs parallel to the section 9 of the transport band 6, and also extending beyond this. Band systems are also implemented in this case, the material web 1 being deflected once or multiple times via multiple material feed rollers, connected upstream from the laying rollers 2, 3, which are identified in greater detail exclusively in FIG. 5 using 31 through 47. The transport bands 6, 7 are implemented as closed.

The transport band 6 rotates around the material web feed rollers 31 through 41. The material web feed rollers 32, 34, 35 through 38, 40, and 41 are installed permanently. The material web feed roller is implemented as a regulating roller for directional stability. The material web feed rollers 31 and 34 are mounted in the position adjustment carriage 24, which is translationally movable in movement direction X, and the material web supply roller 39 is mounted in the translationally movable laying carriage 5.

The transport band 7 rotates around the material web feed rollers 42 through 47. Except for the material web feed rollers 45 and 46, the remaining rollers are permanently installed in the stand 26. The material web feed rollers 45 and 46 are mounted in the laying carriage 5, and the material web feed roller 42 is implemented as a regulating roller for directional stability.

The material web feed rollers 37 and 44 are designed as drive rollers, the transport bands 6, 7 being driven either through separate drives or through a shared drive. Both the position adjustment carriage 24 and the laying carriage 5 are mounted in linear guides. In consideration of the fact that the transport of the material web 1 occurs partially between the two transport bands 6, 7, the material web feed rollers 34 through 39 and 42 through 46 are situated in the band system in such a way that a pressure zone 48 is implemented, the distance between the transport bands 6, 7 able to be adapted. The two material web feed rollers 39 and 46 correspond to the laying rollers 2, 3.

The material web feed rollers 41 and 42 are implemented as web regulating rollers and may be slanted. The center of rotation for the slanting is positioned centrally in the laying module 49. The laying module 49 includes all of the components which are necessary in order to convey a material web 1 exiting from a material web feed device 50 up to the folding location 4.

For the laying module 49 shown in FIG. 6, two larger material web feed rollers 51, 52 are provided. Depending on the overall size of the material web feed rollers 51, 52, acceleration and speed effects may be achieved and gear ratios may be modulated.

A further variant of the fourth exemplary embodiment results from FIG. 7, in which the pressure zone 48 of the laying module 49 is restricted only to the region which extends parallel to the section 9 of the transport band 6. The design implementation therein meets construction requirements and allows the device to be built around corners. The position adjustment carriage 24 moves translationally and vertically in movement direction Z.

In all exemplary embodiments, the transport bands 6, 7 are made of an antistatic material and are graphite-coated. In addition, the folding location 4 is always implemented as a baseplate and is positioned on a conveyor band 53.

The height of the conveyor band 53 is adjustable in the movement direction Z and exerts a pressure on each folded layer of the material web 1 and/or the material web stack 54 formed therefrom. The counterpressure is implemented via the section 8, 9 of the transport band 6, 7 extending parallel to the folding location 4 and/or to the uppermost folded layer of the material web 1. In regard to FIG. 2, the counterpressure is applied by the holding-down band 10, 11, which extends parallel to the folding location 4 and/or to the uppermost folded layer of the material web 1, particularly by its lower section 12, 13.

Figure 9:
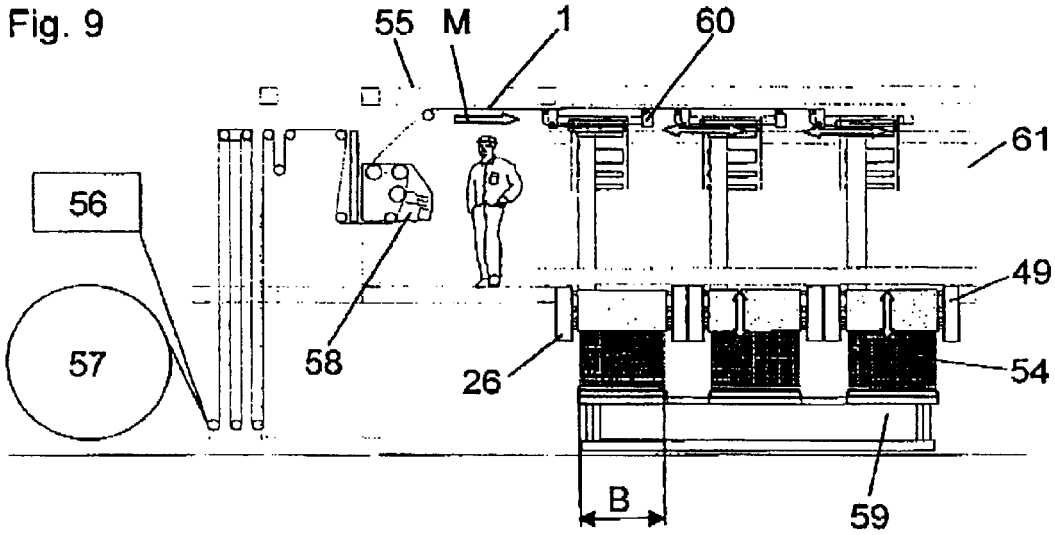
FIG. 9 shows a schematic illustration of a front view of the object from FIG. 5 as a component of an overall arrangement.
Figure 10:
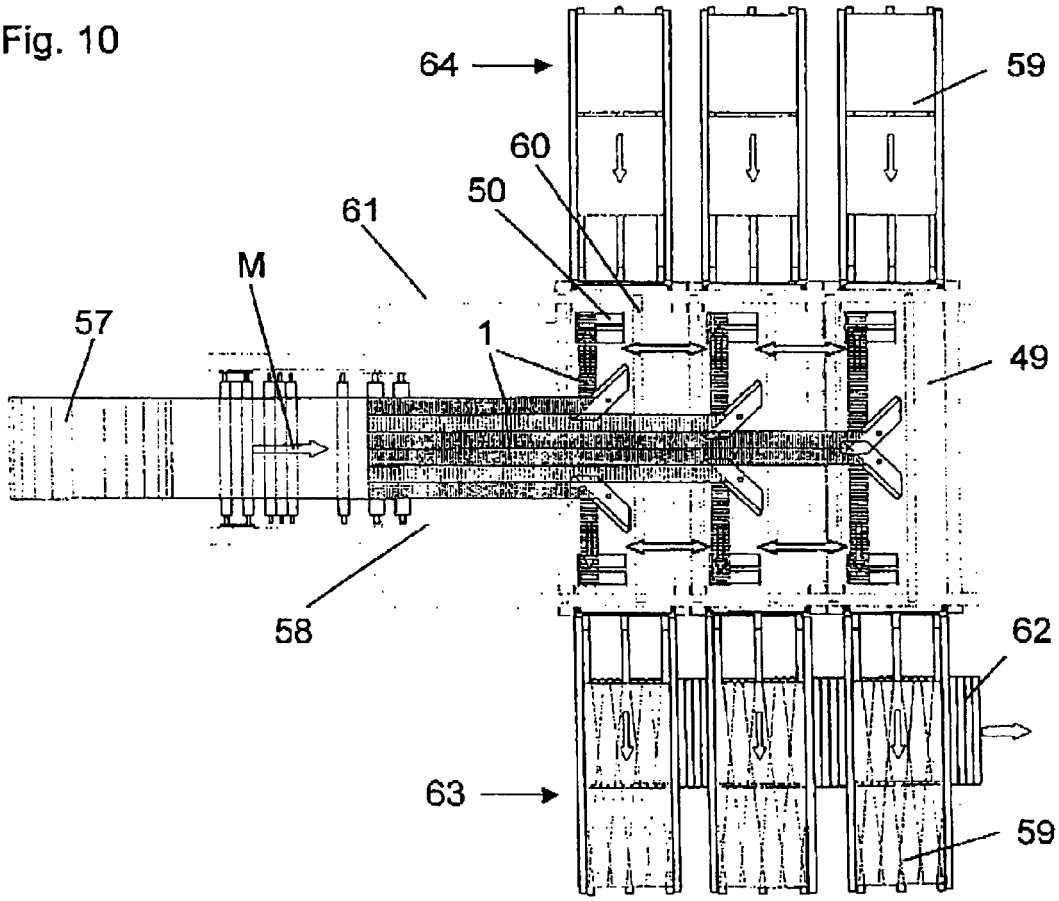
FIG. 10 shows a schematic illustration of a top view of the object from FIG. 9.
Figure 11:
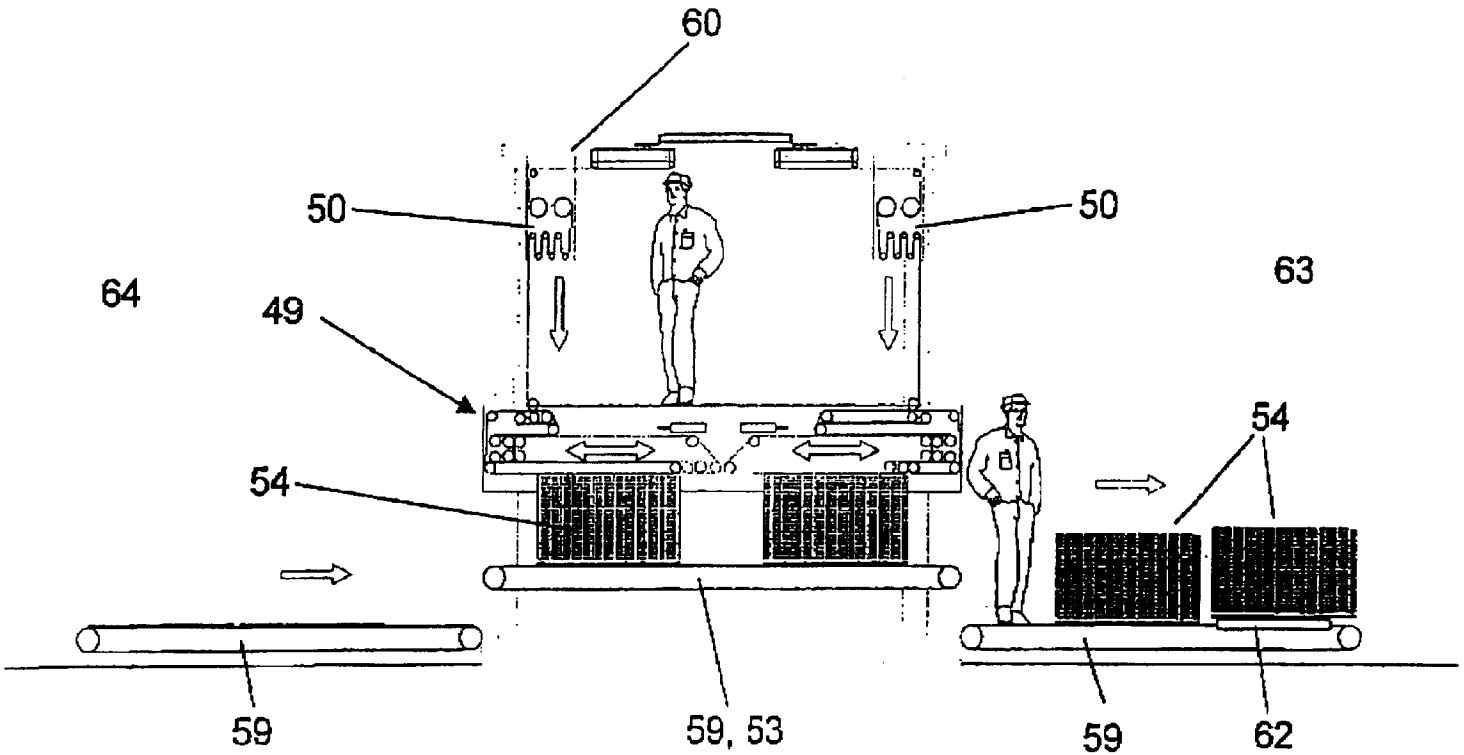
FIG. 11 shows a schematic illustration of a side view of the object from FIG. 9, seen from a viewpoint which is located in front of the cutting device.

FIGS. 9 through 11 show laying modules 49 as components of a modularly constructed overall arrangement 55, which additionally includes a material web source 56 having material coming directly from production, a material web unwinder 57, a material web store (not shown in greater detail), a cutting device 58 for producing a total of six material webs 1, a material web feed device 50, and a conveyor device 59. The three laying modules 49 from FIGS. 9 through 11 correspond to the laying module 49 in the form of a double machine from FIG. 5. A traversing device 60 is positioned upstream from the material web feed device 50, which allows the material web 1 to be transportable over the width B of the laying carriage 5 using its laying rollers 2, 3 and the remaining material web feed rollers (not shown here in greater detail). The main stand of the overall arrangement 55 is indicated by 61.

FIG. 10 shows that the laying modules 49 are positioned perpendicularly to the running direction M of the material web unwinder 57. As is particularly clearly visible from FIG. 11, the conveyor device 59 includes three conveyor bands which are positioned perpendicularly to the running direction M of the material web unwinder 57. The conveyor band 53, whose height is adjustable, is located directly below each laying module 49. Furthermore, transport rollers 62 are provided on the removal side 63 of the conveyor device 59, which convey the arriving material web stack further in parallel to the running direction M of the material web unwinder 57. On the feed side 64, the folding locations 4, in the form of baseplates, are transported via the conveyor device 59 to the laying module 49. The two conveyor bands (not shown in greater detail) on the feed and removal sides 63, 64 are mounted together with the conveyor band 53 on a shared lifting stand (not shown here), which is adjusted via motorized lifting spindles and a corresponding lifting controller to the particular laying high necessary, i.e., moved into either the start or removal position. For the process, when the material web stack 54 is changed, the finished material web stack 54 is moved out of the device to the removal side 63 and simultaneously empty folding locations 4 are pulled in from the feed side 64. In addition, positioning and fixing means (not shown) are provided in the conveyor device 59, which position and fix the folding locations 4.

Figure 12:
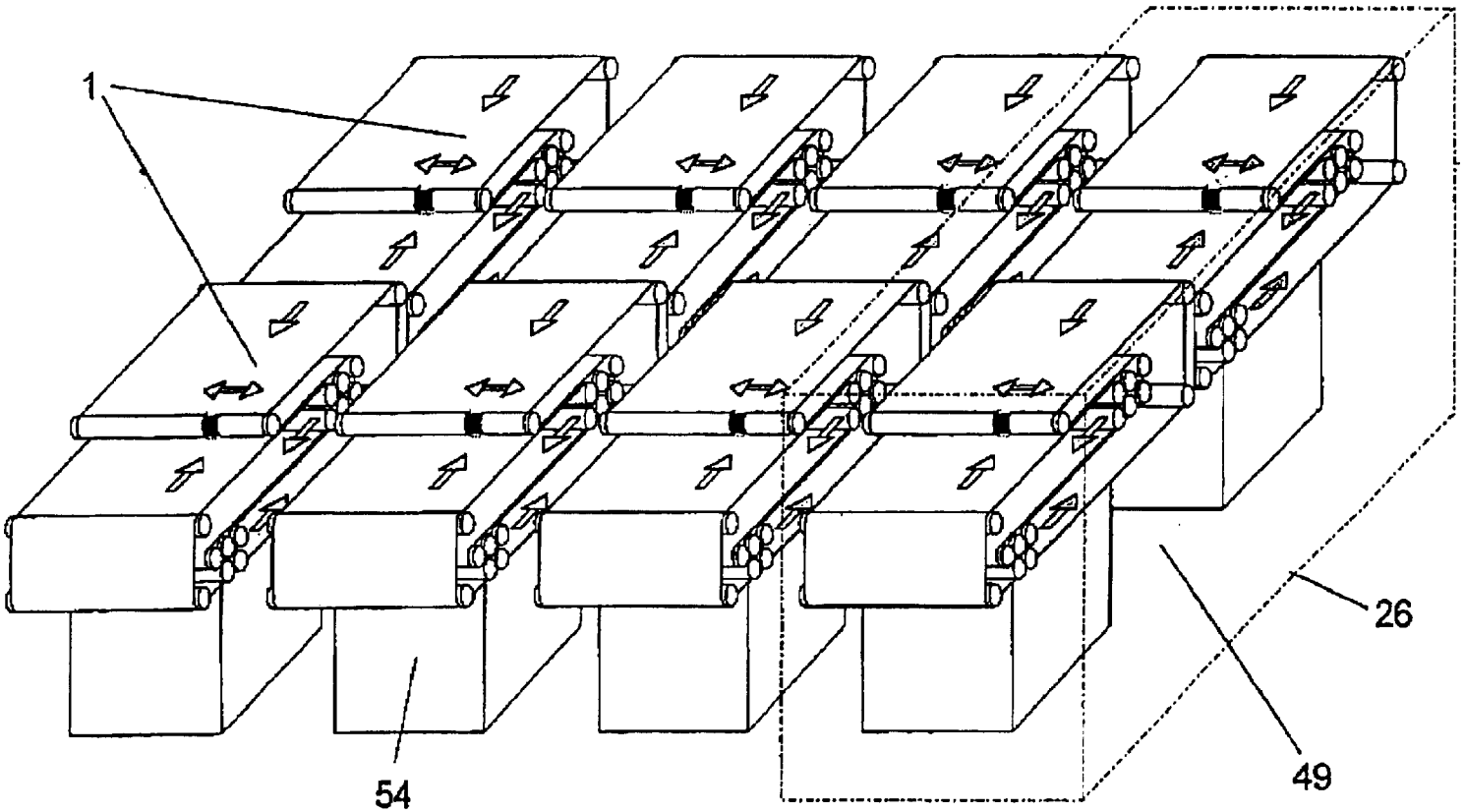
FIG. 12 shows a schematic perspective illustration of the object from FIG. 5 as a component of an overall arrangement made of four double machines.

FIG. 12 shows an arrangement of four double machines as shown in FIG. 5. The material web 1 is transported over the width B of the laying modules 49. Two material web stacks 54 are implemented per laying module 49 and/or per double machine.

Figure 13:
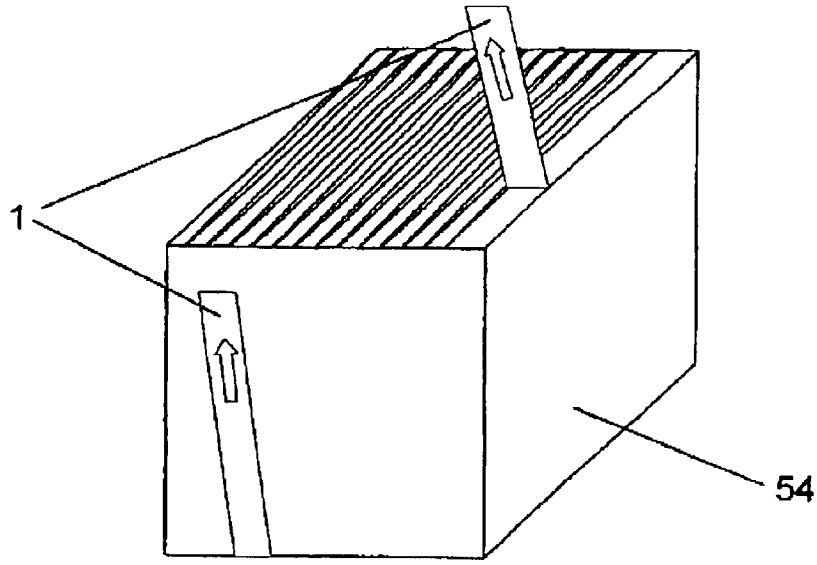
FIG. 13 shows a schematic perspective illustration of a finished material web stack in a zigzag fold.
Figure 14:
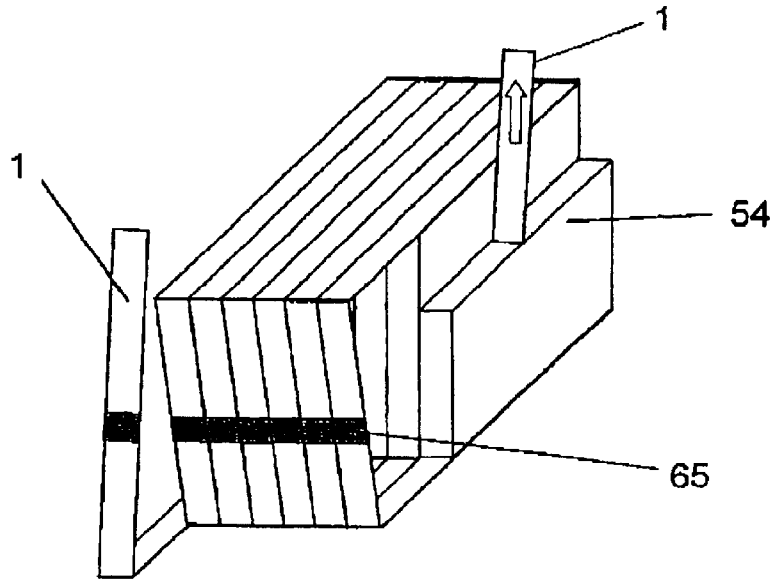
FIG. 14 shows a schematic perspective illustration of a finished material web stack in a parallel fold.

Two types of material web stack 54 are shown in FIGS. 13 and 14, specifically a zigzag stack and a stack having material webs 1 folded in parallel, which are connected to one another via glue points 65.

Figure 16:
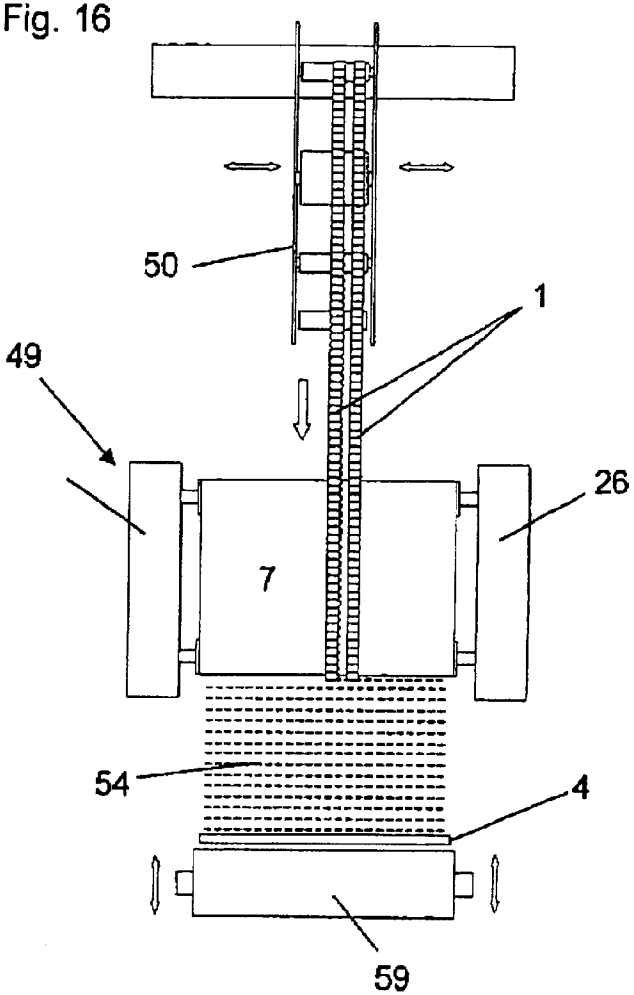
FIG. 16 shows a schematic illustration of a front view of the laying module having two material webs and a folding location.
Figure 15:
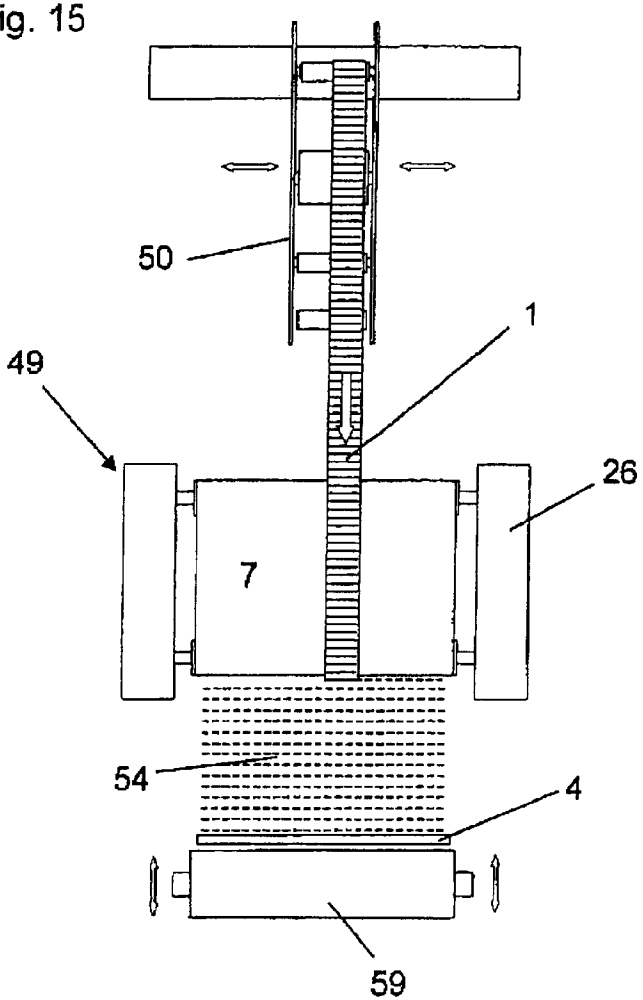
FIG. 15 shows a schematic illustration of a front view of a laying module having a material web and a folding location.
Figure 17:
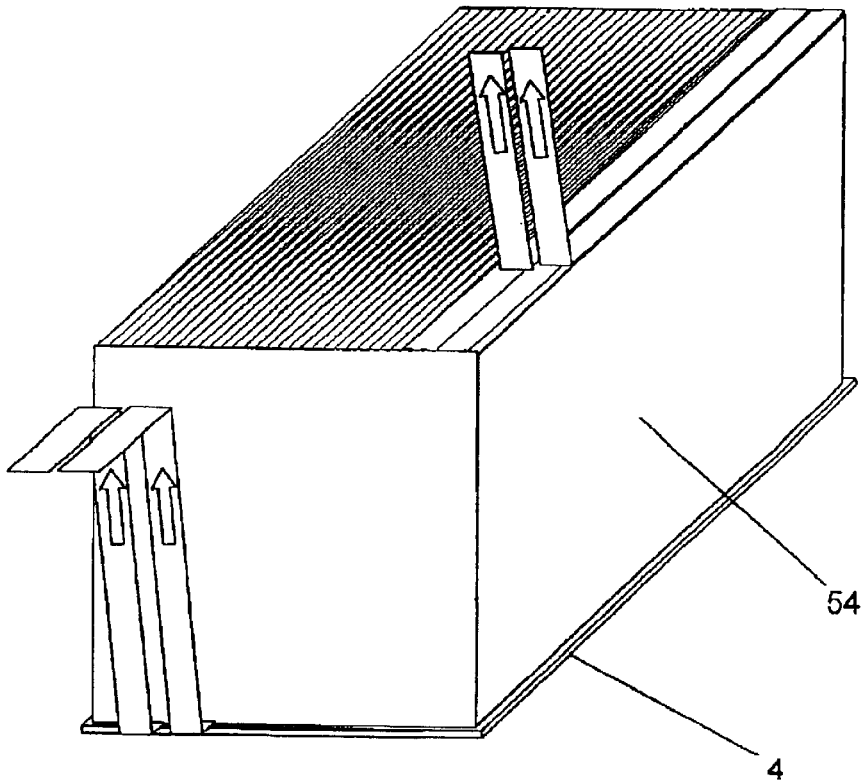
FIG. 17 shows a schematic perspective illustration of a finished material web stack from the laying module shown in FIG. 16.
Figure 18:
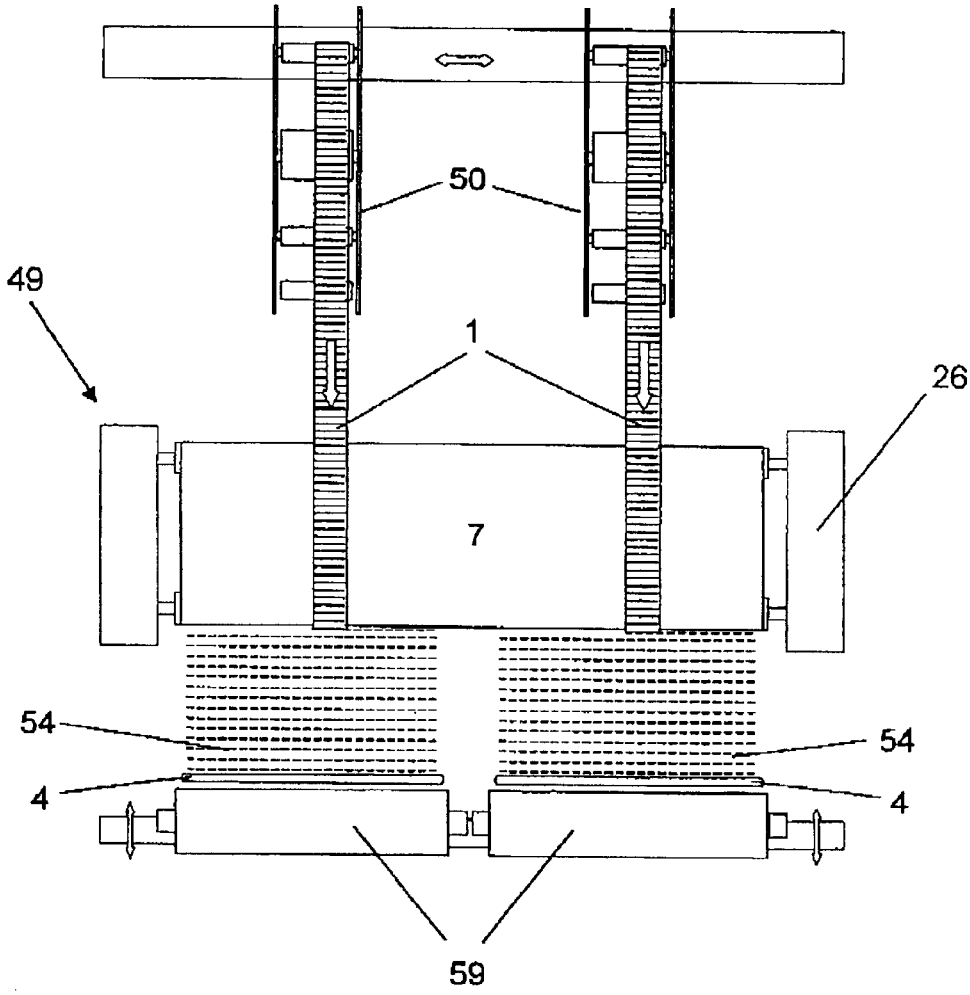
FIG. 18 shows a schematic illustration of a front view of a laying module having two material webs and a folding location.
Figure 19:
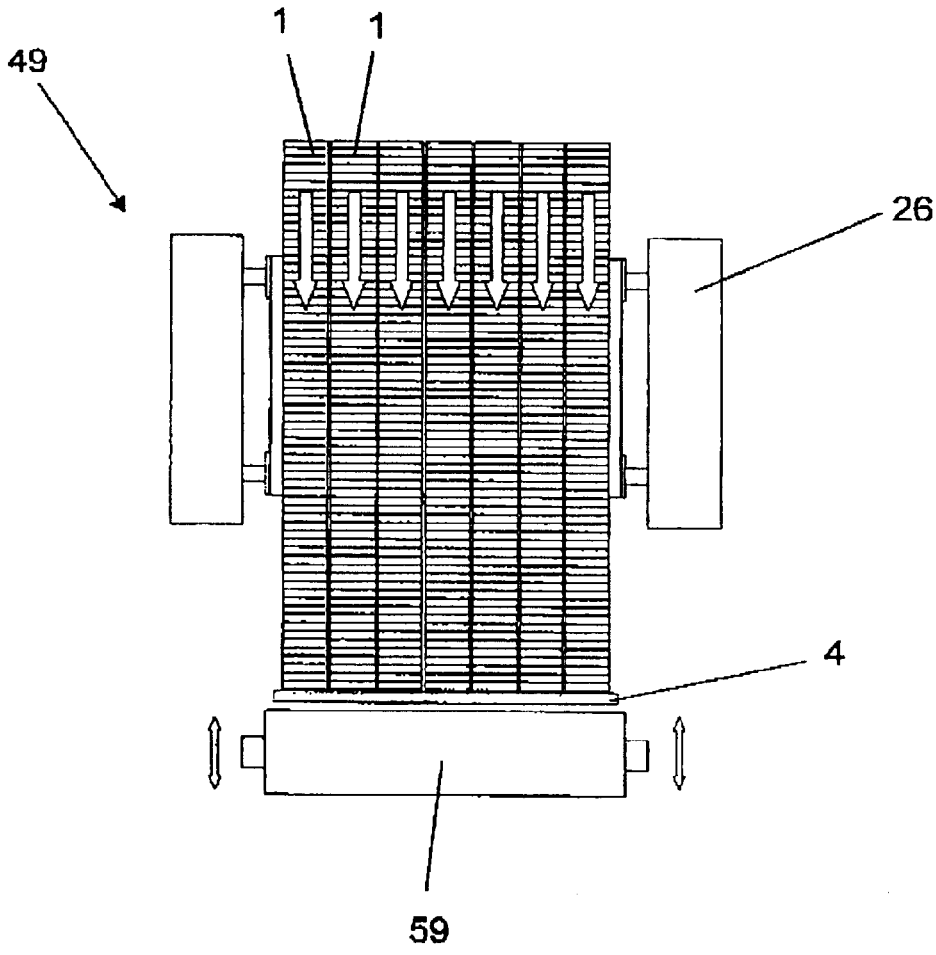
FIG. 19 shows a schematic illustration of a front view of a laying module having seven material webs and a folding location.

FIGS. 15, 16, and 19 show laying modules 49, one material web 1 (FIG. 15), or two material webs 1 (FIG. 16), or seven material webs 1 (FIG. 19) being fed simultaneously to a folding location 4. FIG. 17 shows a finished material web stack 54 as it is produced in the laying module 49 shown in FIG. 16. A laying module 49 having two material webs 1, two material supply devices 50, and two folding locations 4 is shown in FIG. 18.

Reference is made to the general part of the description in regard to further features not shown in the figures.

Finally, it is to be noted that the teaching according to the present invention is not restricted to the exemplary embodiments described above. Rather, greatly varying embodiments of the overall arrangement and the individual laying modules are possible.

While the foregoing description and drawings represent the present invention, it will be obvious to those skilled in the art that various changes may be made therein without departing from the true spirit and scope of the present invention.

List of Reference Numbers

1 material web
2 laying roller
3 laying roller

4 folding location
5 laying carriage
6 transport band
7 transport band
8 section of 6 parallel to 1
9 section of 7 parallel to 1
10 holding-down band
11 holding-down band
12 lower section of 10
13 lower section of 11
14 holding-down roller
15 holding-down roller
16 drive motor
17 support and tensioning device
18–21 material web supply rollers
22 transport band
23 transport band
24 position adjustment carriage
25 toothed belt
26 stand
27–29 toothed belt pulley
30 deflection roller
31–47 material web feed rollers
48 pressure zone between 6, 7
49 laying module
50 material web feed device
51–52 material web feed rollers
53 conveyor band
54 material web stack
55 overall arrangement
56 material web source
57 material web unwinder
58 cutting device
59 conveyor device
60 traversing device
61 main stand
62 transport rollers
63 removal side of 59
64 feed side of 59
65 glue points of 54
L folding length
X horizontal movement direction
Z vertical movement direction
B width

What is claimed is:

1. A device for folding a flexible material web comprising:

at least one pair of counterrotating layering rollers, between which the material web may be fed to a folding location, said laying rollers being part of a laying carriage which is movable over the folding length of the material web with reversible orientation;

said laying carriage including two transport bands which at least rotate around the laying rollers, the material web being transportable at least partially guided between the transport bands, and the speed of the material web having the same absolute value as the speed of the transport bands;

said folding position having a height which is adjustable in the movement direction and the folding position exerting a pressure on a layer of the material web or on a material web stack formed by multiple folded layers of the material web;

a counterpressure able to be implemented via the section of the transport band extending parallel to the folding location and/or to the uppermost folded layer of the material web, or a counterpressure able to be implemented via the lower section of a holding-down band extending parallel to the folding location and/or to the uppermost folded layer of the material web.

2. The device according to claim 1, wherein the section of the transport band or the lower section of the holding-down band varies in its lengthwise dimension in regard to its active material web contact region as the laying carriage moves, depending on the position of the carriage.

3. The device according to claim 1, wherein the separate holding-down band is assigned to separate holding-down rollers of the laying carriage.

4. The device according to claim 1, wherein a support and tensioning device is provided in consideration of the variability of the transport band or the holding-down band.

5. The device according to claim 1, wherein a drive motor or a magnetic drive, particularly in the form of a long-stator linear drive is provided for the laying carriage and/or the transport bands.

6. The device according to claim 1, wherein the laying carriage has further material web feed rollers, via which the material web may be fed in a freely settable movement direction to the laying rollers.

7. The device according to claim 6, wherein the material web feed rollers are equipped with a further transport band.

8. The device according to claim 1, wherein at least one position adjustment carriage is provided, which works together with the laying carriage.

9. The device according to claim 8, wherein the position adjustment carriage includes a toothed belt which works together with the support and tensioning drive.

10. The device according to claim 1, wherein the folding location is positioned on a supporting surface, particularly the conveyor band or the platform, may have its height adjusted in the movement direction.

11. The device according to claim 1, wherein the laying carriage is a component of a laying module.

12. The device according to claim 11, wherein the laying module is a component of an overall arrangement, which additionally includes a material web unwinder, a cutting device, a material web feed device, and possibly a conveyor device.

13. The device according to claim 12, wherein the laying module or multiple laying modules is/are positioned parallel or perpendicular to the running direction of the material web unwinder.

14. The device according to claim 1, wherein the material web is transportable over the width of the laying rollers and/or the laying module.

15. The device according to claim 1, wherein at least two material webs may be fed simultaneously in parallel to at least on folding location.

16. The device according to claim 1, wherein the material web approximately corresponds to the width of the laying rollers and/or the laying module.

17. The device according to claim 1, wherein the width of the laying rollers and/or of the entire laying module is approximately 800 mm to 4000 mm.

18. The device according to claim 1, wherein the folding length of the material web stack is approximately 1200 mm to 2700 mm.

19. The device according to claim 1, wherein the height dimension of the material web stack is approximately 800 mm to 1500 mm.

20. The device according to claim 1, wherein the transport bands implement a pressure zone.

21. The device according to claim 1, wherein upstream from laying rollers, a material web feed device is provided, from which the material web reaches material web feed rollers and may be deflected one or multiple times via said web feed rollers.

22. The device according to claim 1, wherein the two transport bands set the laying rollers of the laying carriage into motion.

23. A method of folding a flexible material web, comprising the steps of:

feeding the material web to at least one folding location via at least one counterrotating pair of laying rollers, the material web being movable together with the laying rollers over their folding length, and an orientation change corresponding to a freely selectable folding length occurring during the method, said further comprising the steps of:

transporting the material web to the folding location between two transport bands, which rotate at least around the laying rollers;

moving the material web at the same speed as the transport bands, and adjusting the height of the folding position in such a way that the top of the uppermost folded material web is in contact with the transport band or a holding-down band during the folding and its bottom is in contact with the folding location or the material web stack.

24. The method according to claim 23, comprising the step of transporting the folding location on a transport band to a supporting surface, whose height is adjustable, particularly to the conveyor band, and, after being filled with the material web, is removed together with the material web stack on a transport band.

* * * * *